US012570462B2

(12) United States Patent
Zhang et al.

(10) Patent No.: US 12,570,462 B2
(45) Date of Patent: Mar. 10, 2026

(54) TELESCOPIC VENTILATION PIPELINE DEVICE FOR COAL STORAGE SILO

(71) Applicant: HUANENG POWER INTERNATIONAL, INC. SHANGHAI SHIDONGKOU FIRST POWER PLANT, Shanghai (CN)

(72) Inventors: Xiao Zhang, Shanghai (CN); Feng Han, Shanghai (CN); Yubin Xu, Shanghai (CN); Chenghui Jin, Shanghai (CN); Shenyu Zhang, Shanghai (CN); Haokai Chen, Shanghai (CN); Ning Zhang, Shanghai (CN)

(73) Assignee: HUANENG POWER INTERNATIONAL, INC. SHANGHAI SHIDONGKOU FIRST POWER PLANT, Shanghai (CN)

( * ) Notice: Subject to any disclaimer, the term of this patent is extended or adjusted under 35 U.S.C. 154(b) by 542 days.

(21) Appl. No.: 18/156,483

(22) Filed: Jan. 19, 2023

(65) Prior Publication Data

US 2023/0382634 A1 Nov. 30, 2023

(30) Foreign Application Priority Data

May 31, 2022 (CN) ..... 202210613626.4

(51) Int. Cl.
*B65D 88/74* (2006.01)

(52) U.S. Cl.
CPC ..... *B65D 88/745* (2013.01)

(58) Field of Classification Search
CPC ..... B65D 88/742; B65D 2588/743; B65D 90/34; A01F 25/22
See application file for complete search history.

(56) References Cited

U.S. PATENT DOCUMENTS

2013/0102330 A1 4/2013 Lee
2022/0146127 A1 5/2022 Landrette et al.
2022/0315324 A1 10/2022 Zhang et al.

FOREIGN PATENT DOCUMENTS

CN 202303752 U 7/2012
CN 111013273 A 4/2020
(Continued)

OTHER PUBLICATIONS

First Office Action dated Jul. 30, 2025 for CN patent application No. 202210613626.4.

*Primary Examiner* — Edelmira Bosques
*Assistant Examiner* — Michael James Giordano
(74) *Attorney, Agent, or Firm* — DINSMORE & SHOHL LLP

(57) ABSTRACT

A telescopic ventilation pipeline device for a coal storage silo includes a second fan, an upper air pipe fixing interface, a telescopic air pipe, a bottom air pipe fixing interface, a mounting platform, and a ventilation air pipe, the telescopic air pipe being parallel to a central telescopic feed pipe of the silo, one end of the upper air pipe fixing interface being connected to the second fan, the other end thereof communicating with the top end of the telescopic air pipe, the bottom end of the telescopic air pipe, the bottom air pipe fixing interface and the ventilation air pipe communicating in sequence, and the bottom air pipe fixing interface being fixed to a spiral framework A-type frame of the silo. Compared with the prior art, the telescopic ventilation pipeline device is high in safety and ventilation efficiency and incapable of affecting the normal operation of the silo.

10 Claims, 10 Drawing Sheets

(56) References Cited

FOREIGN PATENT DOCUMENTS

| | | | |
|---|---|---|---|
| CN | 113044418 | A | 6/2021 |
| CN | 213510702 | U | 6/2021 |
| KR | 20110109018 | A | 10/2011 |

TELESCOPIC VENTILATION PIPELINE DEVICE FOR COAL STORAGE SILO

CROSS REFERENCE TO RELATED APPLICATION

This application claims priority to Chinese Application 202210613626.4, filed May 31, 2022, which is hereby incorporated by reference in its entirety.

TECHNICAL FIELD

The present disclosure relates to the field of silos, in particular to a telescopic ventilation pipeline device for a coal storage silo.

BACKGROUND

Coal storage in an silo is the domestic latest environment-friendly coal storage manner. However, the type of coal used for coal storage in the silo abroad greatly differs from that at home, and therefore, there are great differences in situations caused by coal storage. At present, the coal used at home is higher in moisture content (the sum of internal and external water can be up to 30% or above), an acidic material can be formed by mixing a great deal of volatilized moisture and various gases generated by coal oxidation together and can be adhered to surfaces of various equipment and metal structures in the silo to cause corrosion and rusting, which severely causes hazards to the service life and structural safety of the equipment.

In addition, poisonous and harmful gases volatilized from the coal stacked in the silo can not only cause fire risks, but also can cause hazards to the physical safety of overhaul and operation personnel entering the silo.

In order to reduce the oxidation of coal in the silo or avoid spontaneous combustion and guarantee the safety of coal storage, releasing nitrogen into the coal in the silo is generally adopted to stop the oxidation of the coal. However, by adopting such a manner, the released nitrogen is unavoidably diffused into a space where no coal is stacked in the silo, so that the content of oxygen in air above a coal heap in the silo can be reduced, and if personnel are required to rapidly enter the silo to handle problems at the moment, the risk of choking caused by an excessively low oxygen concentration can be caused.

As shown in FIG. 2, although two sets of first fans 16 are disposed on a silo top cover 15 of the silo, an actual exhaust effect is poor, which is mainly due to the fact that various generated gases and moisture are mainly gathered in a region near the upper surface of the coal heap in the silo. Gases in the region near the fans are mainly exhausted by the first fans 16 mounted on the silo top cover 15 of the silo, the silo top cover 15 of the silo is not a sealed container, there are various gaps on many structural junctions of the silo, e.g. between the silo top cover 15 and a barrel body 1, and thus, the gases may enter the silo and then flow to the first fans 16 so as to be exhausted by the first fans 16. The flow of the gases always occurs on a place where the resistance is the lowest, and therefore, the efficiency of such gas flow from bottom to top is very low, which enables the upward flow speeds of the gases close to the coal heap are very low; particularly, when the surface of the coal heap is farther from the first fans 16 of the silo top cover 15 in a case that the height of the coal heap in the silo is lower, that is, the coal storage capacity is lower, the exhaust effects of the first fans 16 are relatively poor, according to observation for actual conditions, it takes at least 10 h if the gases in the silo are intended to be exchanged to be clean, such a situation severely restricts the timeliness of operation of personnel entering the silo, can also bring hidden danger for the safety of coal storage in the silo, and severely affects the production operation of normal coal storage of the silo.

As shown in FIG. 1, in order to achieve the function, that the coal enters the silo so as to be stacked and exits the silo so as to be taken, of the silo, the silo is internally equipped with a complete set of entered/exited coal stacking/taking equipment mainly composed of a rotary trestle 4, a trestle traveling mechanism 5, a central rotating platform 13, a central telescopic feed pipe 6, a spiral framework 8, a screw conveyor 9, an spiral framework A-type frame 11, etc.; the top of the silo is provided with a coal conveying trestle 3 in which a belt conveyor is disposed; and coal is conveyed to an inlet of the central telescopic feed pipe 6 on the upper part of the silo by the conveyor and then enters the inside of the silo via the central telescopic feed pipe 6. The coal is pushed out and spread out by using a spiral stacking/taking device so as to be stacked layer by layer, meanwhile, the rotary trestle 4 does circular movement on a fixed horizontal plane in the silo under the drive of the trestle traveling mechanism 5, the spiral framework A-type frame 11 is hung on the rotary trestle 4 via a spiral framework lifting steel wire rope 7 and rotates with the rotation of the rotary trestle 4, the hung steel wire rope enables the spiral framework A-type frame 11 to do lifting movement via a winding device, it is satisfied that the spiral framework A-type frame 11 always changes with the change of the stacking height of the coal, the central telescopic feed pipe 6 is formed by concentrically linking a plurality of segments of circular pipes with different diameters, and every two adjacent segments of circular pipes are hooked together to be inseparate, but relatively slidable along the axial direction of the barrel body; and due to such a structure, the complete set of telescopic feed pipe is expanded or shrunk segment by segment along with the increment or reduction of the distance between two ends, the telescopic length can satisfy the change of the distance between the rotary trestle 4 and the spiral framework A-type frame 11, and thus, it is ensured that a material always passes in the central telescopic feed pipe 6. It can be seen that a region between the rotary trestle 4 and the spiral framework A-type frame 11 in the silo is a space required to be occupied by the operation of the equipment, apparently, it is impossible to dispose fixed ventilation pipeline equipment in this space, and the current coal storage silo has no corresponding ventilation device other than silo top fans to satisfy a rapid and efficient ventilation demand.

SUMMARY

The present disclosure aims at overcoming detects existing in the prior art to provide a telescopic ventilation pipeline device for a coal storage silo, which is high in safety, high in ventilation efficiency and incapable of affecting the normal operation of the silo.

The objective of the present disclosure can be achieved by the following technical solutions:

provided is a telescopic ventilation pipeline device for a coal storage silo, including a second fan, an upper air pipe fixing interface, a telescopic air pipe, a bottom air pipe fixing interface, a mounting platform, and a ventilation air pipe, the telescopic air pipe being parallel to a central telescopic feed pipe of the silo, one end of the upper air pipe fixing interface being connected to the second fan, the other end thereof communicating with the top end of the telescopic air pipe, the bottom end of the telescopic air pipe, the bottom air pipe fixing interface and the ventilation air pipe communicating in sequence, and the bottom air pipe fixing interface being fixed to a spiral framework A-type frame of the silo.

Further, the telescopic air pipe includes a plurality of segments of air pipe barrels coaxially nested in sequence; the upper end of each air pipe barrel located in the middle is provided with an upper limiting baffle ring, and the lower end thereof is provided with a lower limiting baffle ring; the lower end of the air pipe barrel located on the top end is provided with a lower limiting baffle ring; the upper end of the air pipe barrel located on the bottom end is provided with an upper limiting baffle ring, and the lower end thereof is provided with a lower interface flange; the lower interface flange is fixedly connected to the bottom air pipe fixing interface; and the air pipe barrel located above is hooked, via a lower limiting baffle ring thereof, with an upper limiting baffle ring of the adjacent air pipe barrel located below.

Further, the upper end of each air pipe barrel is provided with an upper limiting flange, and the upper limiting baffle ring is fixed to the upper limiting flange via fixing bolts.

Further, the telescopic air pipe further includes a sealing element and a sealing element pressing plate; the inner side wall of each air pipe barrel is provided with a step; the sealing element pressing plate is located on the step; an annular groove for placing the sealing element is formed in the bottom of each upper limiting baffle ring; the sealing element is located in the annular groove; and the sealing element is tightly clamped by the upper limiting baffle rings and the sealing element pressing plate via pressing plate bolts.

Further, each air pipe barrel is made of stainless steel, nylon or polyurethane material.

Further, the upper air pipe fixing interface includes a fixing seat and a ventilation pipeline; one end of the ventilation pipeline is provided with a fan flange interface for connecting to the second fan, and the other end thereof is provided with a telescopic air pipe flange interface for connecting to an upper port of the telescopic air pipe; the fixing seat is sleeved on the ventilation pipeline; the fixing seat is provided with fixing feet; and the fixing seat is fixed to a rotary trestle of the silo via the fixing feet.

Further, the bottom air pipe fixing interface includes one or more interface air pipes, an air pipe interface cabinet, a telescopic air pipe interface, one or more blocking plates, a support frame, and the mounting platform; the air pipe interface cabinet respectively communicates with the telescopic air pipe interface and the one or more interface air pipes; an end of the telescopic air pipe interface is provided with a telescopic air pipe interface flange; the telescopic air pipe communicates with the telescopic air pipe interface via the telescopic air pipe interface flange; ends of the one or more interface air pipes are provided with air pipe interface flanges; the ventilation air pipe communicates with the one or more interface air pipes via the air pipe interface flanges; the air pipe interface cabinet is fixed to the mounting platform via the support frame; and the mounting platform is fixed to the spiral framework A-type frame of the silo.

Further, a plurality of interface air pipes are provided, and the plurality of interface air pipes are uniformly disposed on the side walls of the air pipe interface cabinet.

Further, the bottom air pipe fixing interface further includes the one or more blocking plates for blocking the one or more interface air pipes, and the one or more blocking plates are matched with the air pipe interface flanges.

Further, a plurality of air inlets/outlets for ventilation are disposed at intervals in the ventilation air pipe.

Compared with the prior art, the present disclosure has the following beneficial effects:

(1) according to the present disclosure, the telescopic air pipe is parallel to the central telescopic feed pipe of the silo, one end of the upper air pipe fixing interface is connected to the second fan, the other end thereof communicates with the top end of the telescopic air pipe, the bottom end of the telescopic air pipe, the bottom air pipe fixing interface and the ventilation air pipe communicate in sequence, the bottom air pipe fixing interface is fixed to the A-type frame of the spiral framework of the silo, and the telescopic air pipe is freely telescopic, the second fan is capable of forwards and reversely rotating, so that air at the rotary trestle of the silo can be delivered to the spiral frame close to the surface of the coal heap, the function of conveyance by exchanging air at the upper part of a space in the silo and the air in a space near the coal heap can be satisfied, the characteristic of movement of equipment in the silo can be adapted, there is no mutual interference between the normal operation of the device and the operation of mechanisms of the silo, the demand on ventilation at any time is provided, the ventilation efficiency is increased, and the operation of the silo and the safety of working personnel are greatly guaranteed;

(2) according to the present disclosure, the telescopic air pipe includes the plurality of segments of air pipe barrels coaxially nested in sequence, the upper limiting baffle ring of the air pipe barrel located below is in contact and hooked together with the lower limiting baffle ring of the air pipe barrel located above, at the moment, the sealing element can be in direct contact with the upper surface of the lower limiting baffle ring, so that a sealing effect is generated to prevent gases delivered in a pipeline from being leaked;

(3) according to the present disclosure, each air pipe barrel is made of stainless steel, nylon or polyurethane material and is smooth in surface, not easy to deform and resistant to corrosion;

(4) according to the present disclosure, the air pipe interface cabinet is used as an air exchange hub, the plurality of interface air pipes are provided, the plurality of interface air pipes are uniformly disposed on the side walls of the air pipe interface cabinet, and the fixed ventilation air pipe may be disposed on a position, where the walking of personnel is not affected, on the spiral framework and a spiral framework center platform as actually required, so that the layout flexibility of the ventilation air pipe is improved;

(5) according to the present disclosure, the bottom air pipe fixing interface further includes the one or more blocking plates for blocking the one or more interface air pipes, the one or more blocking plates are matched with the air pipe interface flanges, and the one or more interface air pipes which are not used can be blocked, so that leakage is avoided; and (6) according to the present disclosure, the plurality of air inlets/outlets for ventilation are disposed at intervals in the ventilation air pipe, so that the uniformity of gas circulation is improved.

DESCRIPTION FOR REFERENCE NUMERALS IN THE DRAWINGS

1, barrel body; 2, feeding hole; 3, coal conveying trestle on top of silo; 4, rotary trestle; 6, central telescopic feed pipe; 7, spiral framework lifting steel wire rope; 8, spiral framework; 9, stacking/taking screw conveyor; 11, spiral framework A-type frame; 12, central winding platform; 14, spiral framework center platform; 15, silo top cover; 16, first fan; 17, second fan; 18, upper air pipe fixing interface; 19, telescopic air pipe; 20, bottom air pipe fixing interface; 21, mounting platform; 22, ventilation air pipe; 23, air inlet/outlet; 18-1, fixing seat; 18-2, fixing foot; 18-3, ventilation pipeline; 18-4, telescopic air pipe flange interface; 18-5, fan flange interface; 19-1, air pipe barrel; 19-2, upper limiting flange; 19-3, upper limiting baffle ring; 19-4, fixing bolt; 19-5, pressing plate bolt; 19-6, sealing element; 19-7, sealing element pressing plate; 19-8, lower limiting baffle ring; 19-9, step; 19-10, lower interface flange; 20-1, air pipe interface flange; 20-2, interface air pipe; 20-3, air pipe interface cabinet; 20-4, telescopic air pipe interface; 20-5, telescopic air pipe interface flange; 20-6, blocking plate; 20-7, support frame; and 19-3-1, annular groove.

DETAILED DESCRIPTION

The present disclosure will be described in detail below with reference to the accompanying drawings and the specific embodiments. The present embodiments are implemented on the premise of the technical solutions of the present disclosure, detailed implementations and specific operation processes are given in detail, however, the protective scope of the present disclosure is not limited to the following embodiments.

When an existing coal storage silo stores coal high in moisture content and volatility and easy to spontaneously combust, various poisonous and harmful gases are released by the coal, in addition, a great deal of moisture evaporated from the coal may also be gathered in the silo, these gases and the moisture may corrode and damage equipment and various metal structures in the silo after being mixed, moreover, the silo is full of nitrogen after an inactive nitrogen charging method is adopted for safety coal storage, which all restrict the demand on personnel rapidly entering the silo to operate, and therefore, rapid exhaust of the various gases in the silo to the outside of the silo is of great importance to the normal and safe operation of the silo.

Figure 2:
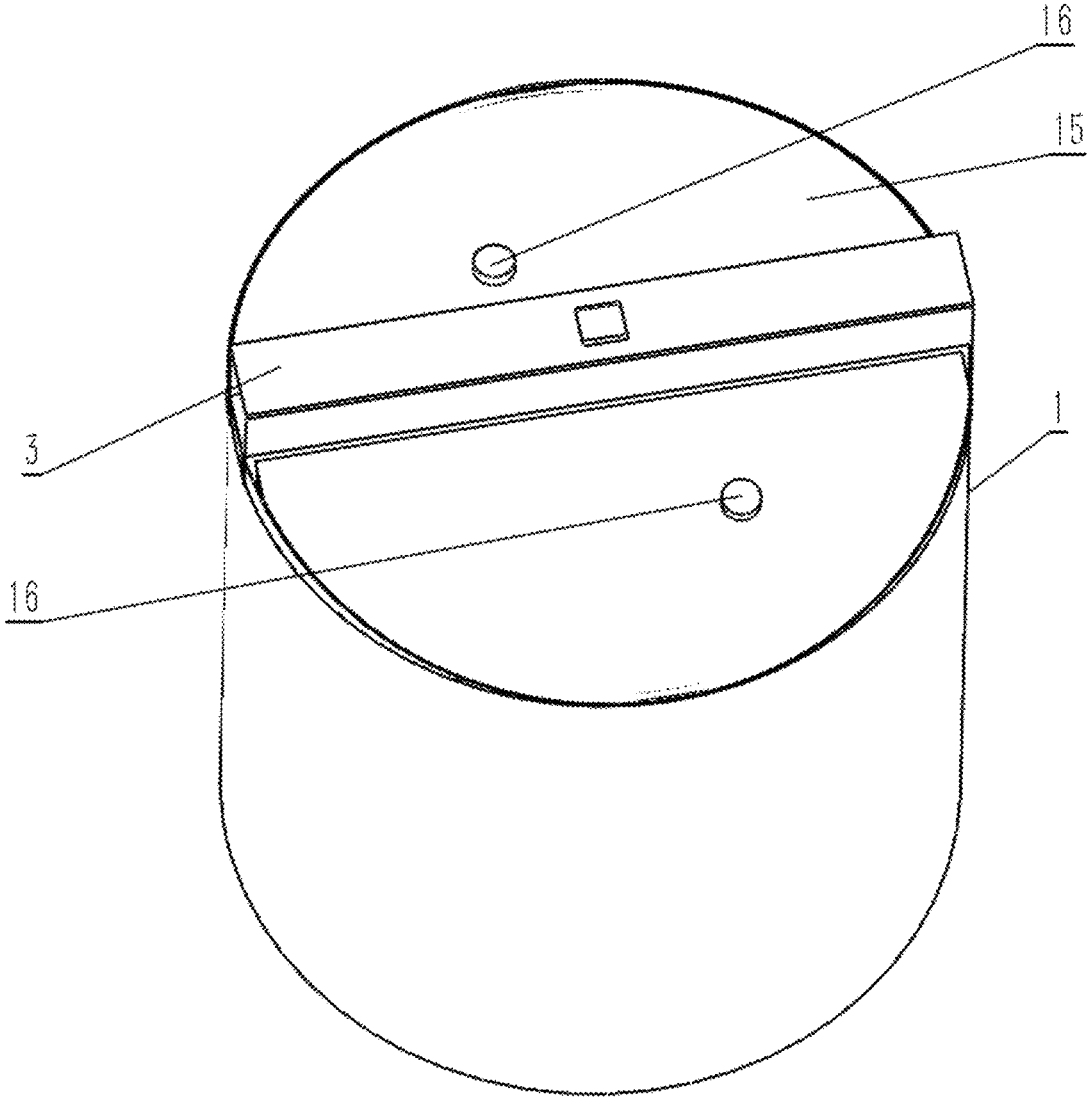
Fig. 2 Prior Art
FIG. 2 is a schematic layout view of a silo top fan of the silo.

As shown in FIG. 2, a silo top cover 15 of the silo can only rapidly exhaust gases in a space on the top of the silo. However, when the stacking level of the coal is lower, the exhaust effect of gases on the lower part inside the silo is very poor. Only if the gases on the lower part are rapidly delivered to a position near the top of the silo, these gases are easily exhausted by silo top fans, or gases in a region on the top of the silo are delivered to a lower space, in this way, original gases on the lower part inside the silo can be rapidly raised to reach the region on the top of the silo so as to be relatively easily exhausted by first fans 16. If the gases in the silo are intended to be rapidly exchanged, the gases in the silo have to flow up and down.

Figure 1:
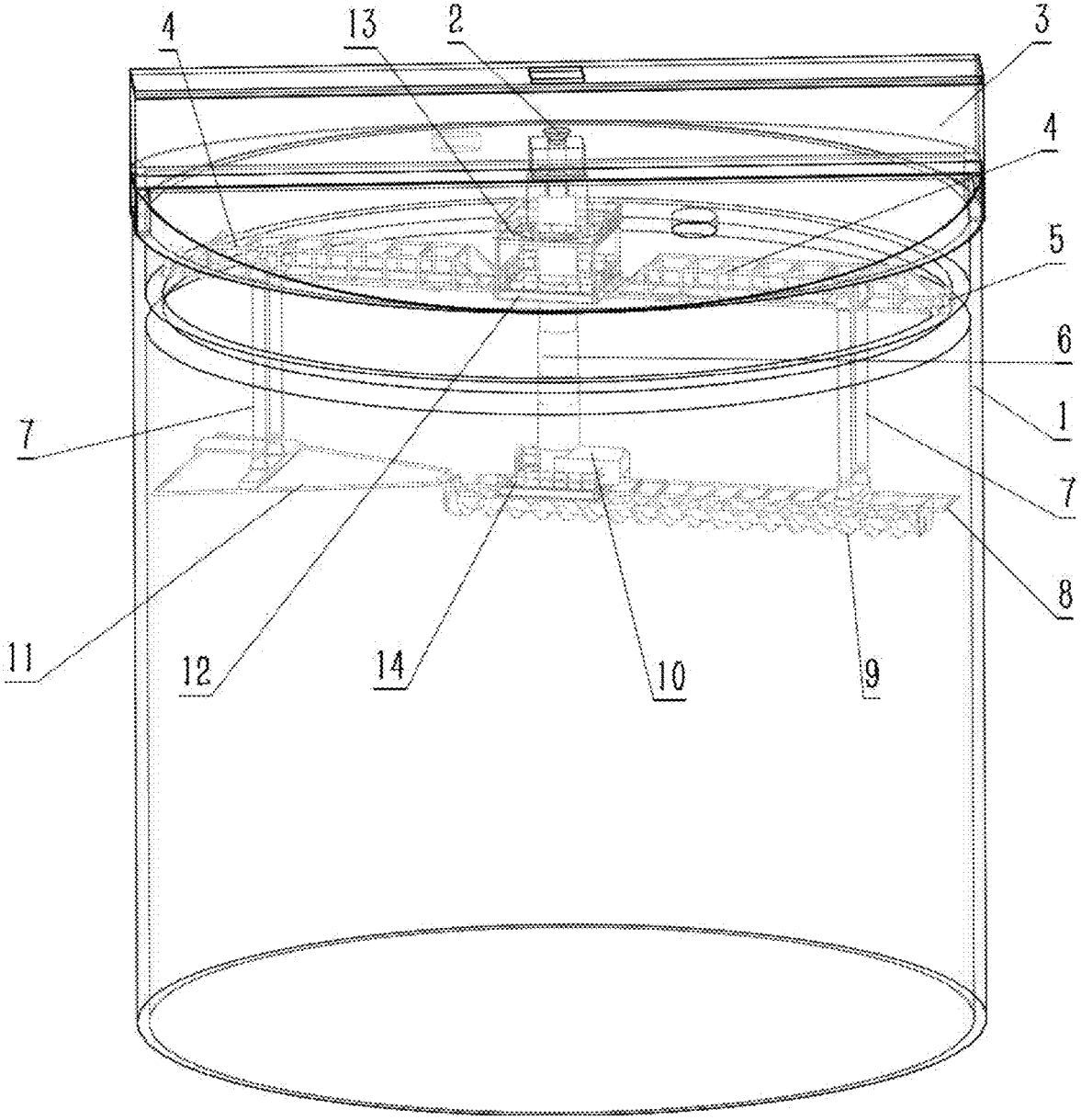
Fig. 1 Prior Art
FIG. 1 is a schematic structural view of a silo.

As shown in FIG. 1, due to a special structure of equipment in the silo, when the equipment in the silo operates, a rotary trestle 4 and a spiral framework 8 inside the silo rotate around a central axis of the silo, the rotary trestle 4 always rotates on a fixed horizontal plane, the spiral framework 8, a spiral framework center platform and a spiral framework A-type frame 11 also rotate around a central axis on a horizontal plane, however, the height of this horizontal plane may move up and down as required by operation, which enables a distance from the fixed horizontal plane for the rotation of the rotary trestle 4 always changes, that is, the rotary trestle 4 and the spiral framework 8 which rotate and the distance therebetween can change with the change of the coal stacking height, and therefore, a conventional air supply device cannot meet the demand on distance change.

The present embodiment provides a telescopic ventilation pipeline device for a coal storage silo, which is configured to establish a ventilation pipeline between a rotary trestle 4 and a spiral framework 8, so that gases surrounding the rotary trestle 4 on the top of the silo are exchanged with gases near the spiral framework 8 on the lower part inside the silo, that is, it is ensured that the gases entering the silo can be successfully delivered from the rotary trestle 4 to the spiral framework 8, or the gases are delivered reversely, and thus, the demand on ventilation inside the silo is satisfied.

A telescopic ventilation pipeline device for a coal storage silo includes a second fan 17, an upper air pipe fixing interface 18, a telescopic air pipe 19, a bottom air pipe fixing interface 20, a mounting platform 21, and a ventilation air pipe 22;

the second fan 17 is an axial flow fan, has the characteristics of explosion proofing as well as forward and reverse rotation, not only can suck gases in a space on the top and deliver them to the bottom inside the silo via the telescopic air pipe 19, but also can reversely rotate blades to suck gases on the bottom inside the silo and deliver them to a space on the top of the silo.

Figure 3:
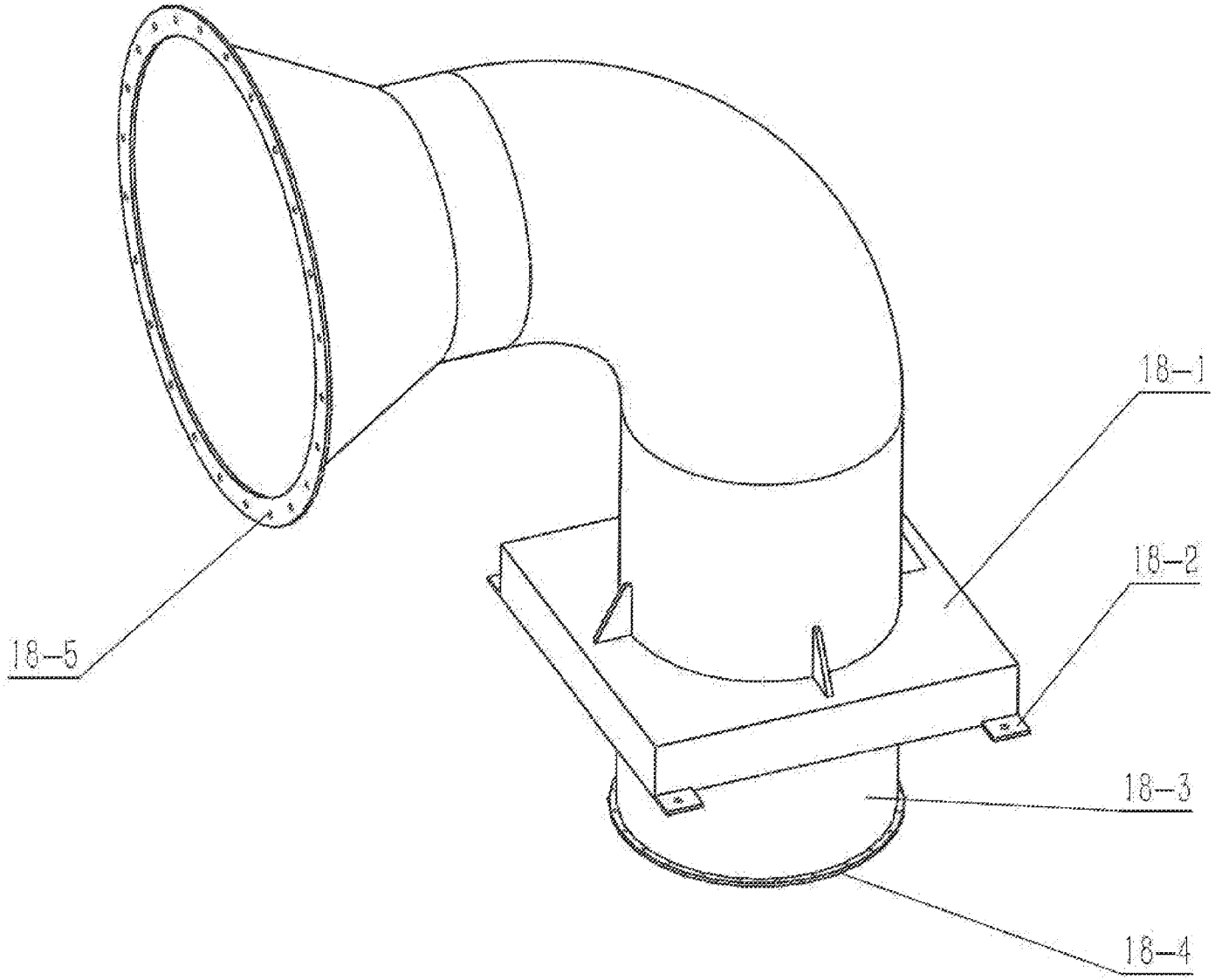
FIG. 3 is a schematic view of an upper air pipe fixing interface.

As shown in FIG. 3, the upper air pipe fixing interface 18 includes a fixing seat 18-1 and a ventilation pipeline 18-3; one end of the ventilation pipeline 18-3 is provided with a fan flange interface 18-5 for connecting to the second fan 17, and the other end thereof is provided with a telescopic air pipe flange interface 18-4 for connecting to an upper port of the telescopic air pipe 19; the fixing seat 18-1 is sleeved on the ventilation pipeline 18-3; the fixing seat 18-1 is provided with fixing feet 18-2; the fixing seat 18-1 is fixed to a rotary trestle 4 via the fixing feet 18-2; and the upper air pipe fixing interface 18 is an upper fixing end of a complete set of telescopic ventilation pipeline device on the rotary trestle 4 on the top of the silo.

Figure 5:
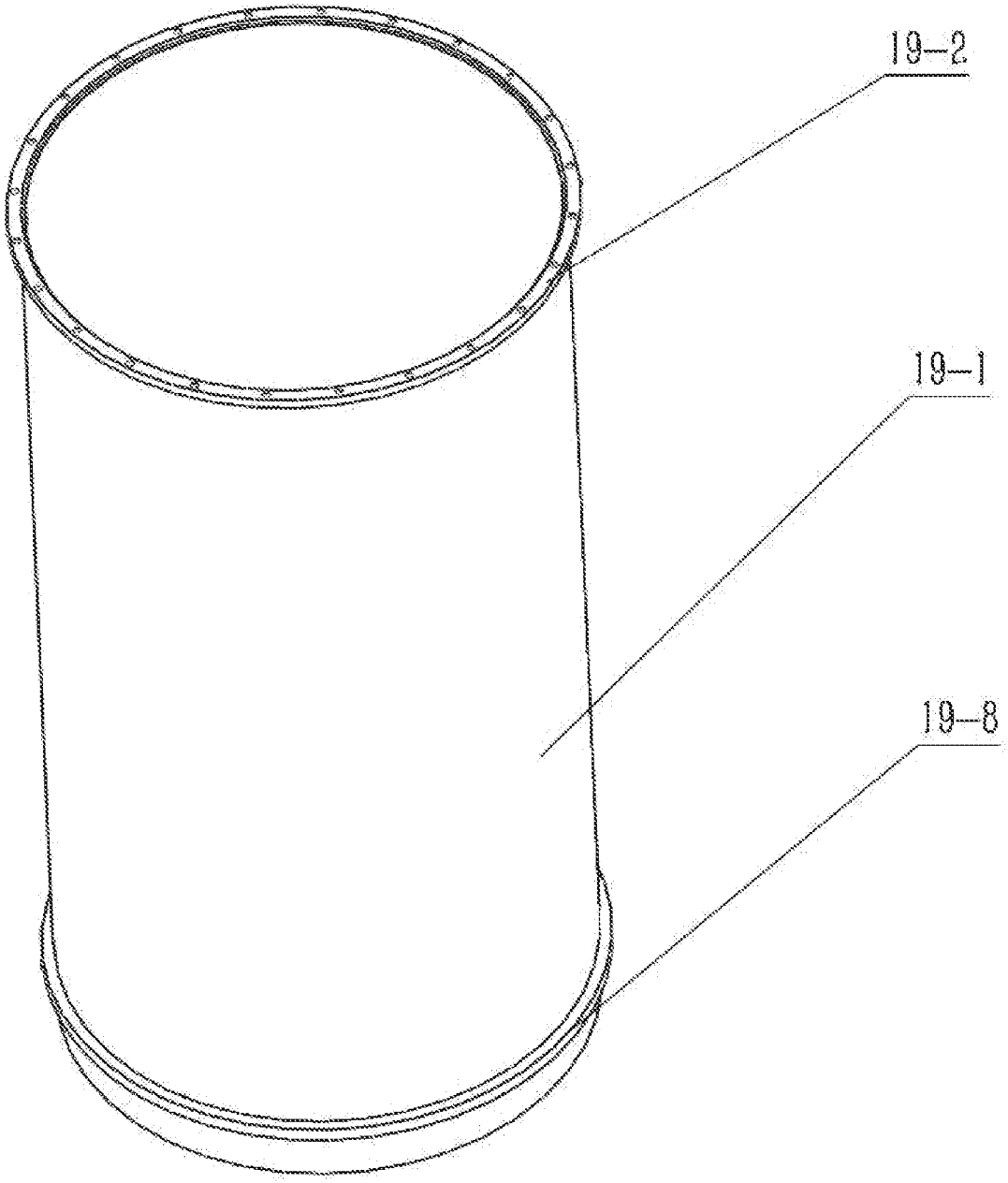
FIG. 5 is a schematic view of a single segment of telescopic air pipe.
Figure 8:
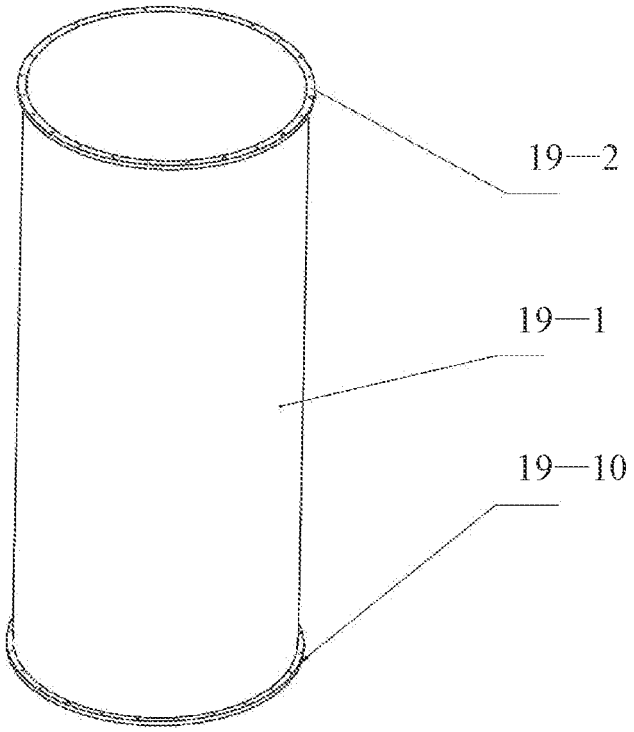
FIG. 8 is a schematic view of a bottom fixing air pipe.

As shown in FIG. 5, the telescopic air pipe 19 includes a plurality of segments of air pipe barrels 19-1 of which the diameters are increased in sequence; the plurality of segments of air pipe barrels 19-1 are concentrically nested; every two adjacent segments of air pipe barrels 19-1 are linked and are characterized by mutually moving along an axis, and therefore, the telescopic air pipe 19 is a ventilation pipeline with two ends between which the length is variable, that is, the telescopic air pipe 19 has extension and shrinkage functions;

all the segments of air pipe barrels 19-1 are the same in structure other than two ends, which are used as interfaces fixedly connected, of the complete set of telescopic air pipe 19; the upper end of each air pipe barrel 19-1 located in the middle is provided with an upper limiting baffle ring 19-3, and the lower end thereof is provided with a lower limiting baffle ring 19-8; the lower end of the air pipe barrel 19-1 located on the top end is provided with a lower limiting baffle ring 19-8; as shown in FIG. 8, the upper end of the air pipe barrel 19-1 located on the bottom end is provided with an upper limiting baffle ring 19-3, and the lower end thereof is provided with a lower interface flange 19-10; the lower interface flange 19-10 is connected to the bottom air pipe fixing interface 20; and the air pipe barrel 19-1 located above is hooked, via a lower limiting baffle ring 19-8 thereof, with an upper limiting baffle ring 19-3 of the adjacent air pipe barrel 19-1 located below.

Figure 6:
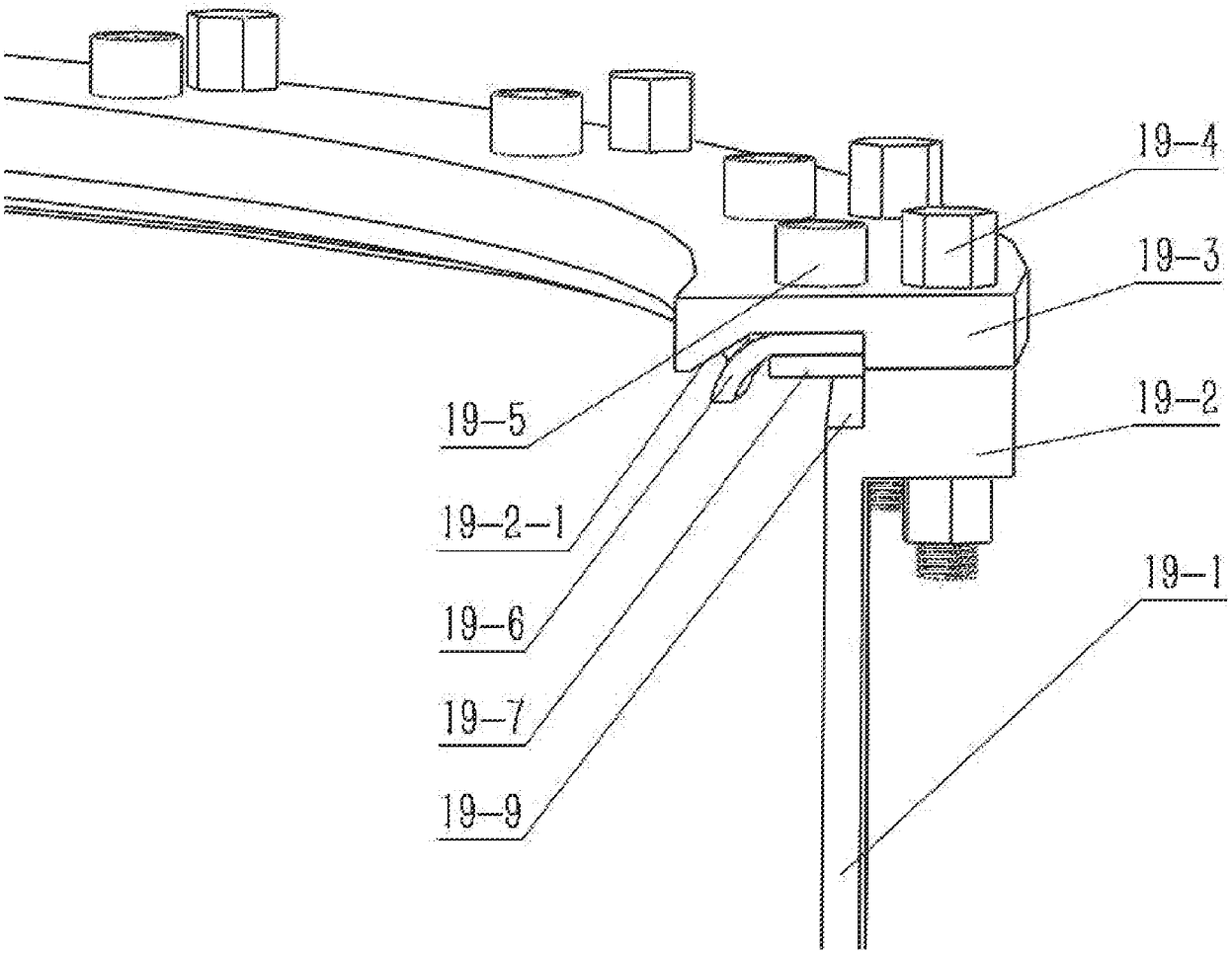
FIG. 6 is a sectional view of the single segment of telescopic air pipe.
Figure 7:
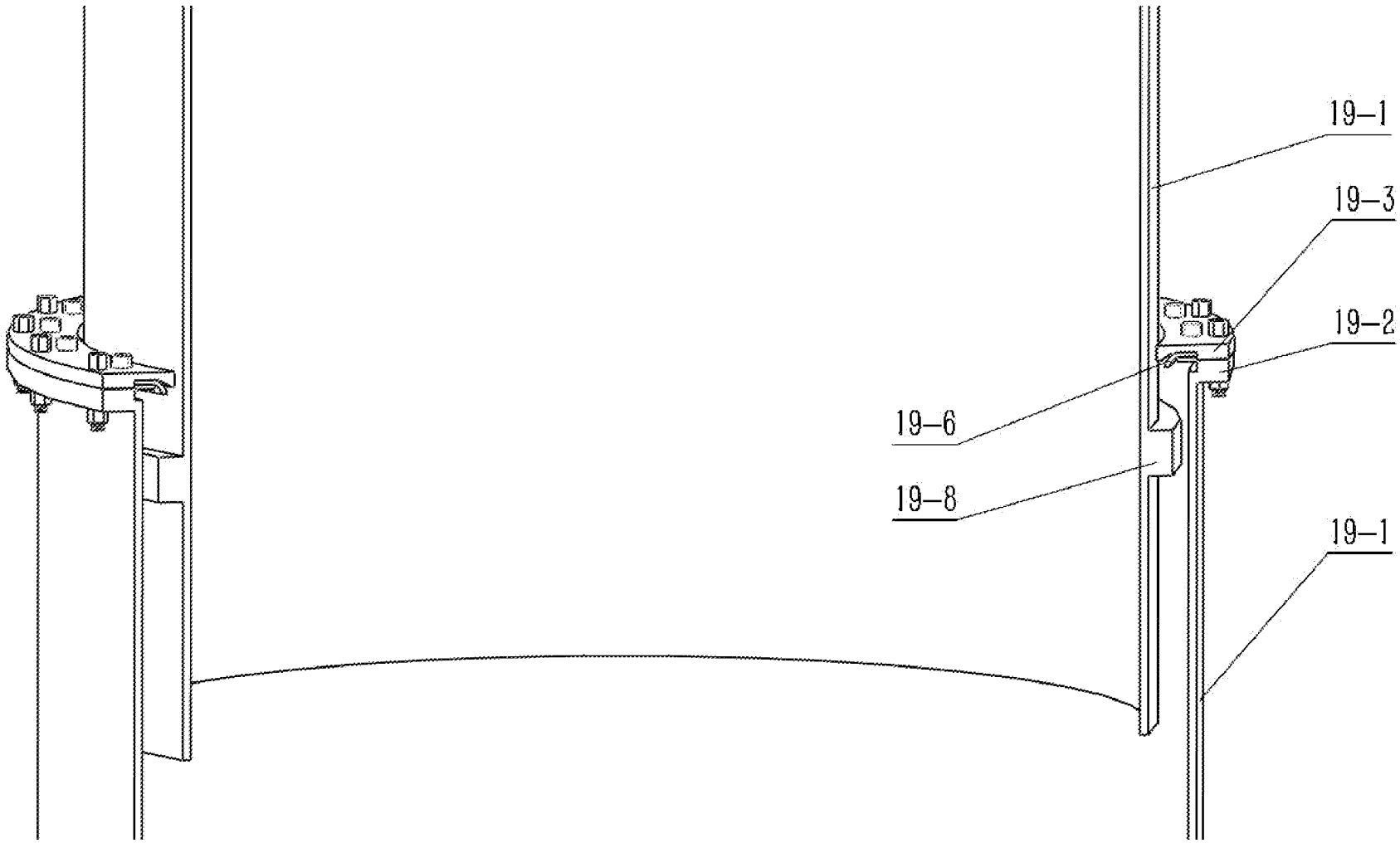
FIG. 7 is a cross-section view showing the linking of two adjacent segments of air pipes.

As shown in FIG. 6 and FIG. 7, the telescopic air pipe 19 further includes a sealing element 19-6 and a sealing element pressing plate 19-7; the upper end of each air pipe barrel 19-1 is provided with an upper limiting flange 19-2, and the upper limiting baffle ring 19-3 is fixed to the upper limiting flange 19-2 via fixing bolts 19-4; the inner side wall of each air pipe barrel 19-1 is provided with a step 19-9; the sealing element pressing plate 19-7 is located on the step 19-9; an annular groove 19-3-1 for placing the sealing element 19-6 is formed in the bottom of each upper limiting baffle ring 19-3; the step 19-9 and the annular groove 19-3-1 are matched to form a space for accommodating the sealing element 19-6 and the sealing element pressing plate 19-7; the sealing element 19-6 is located in the annular groove 19-3-1; the sealing element 19-6 is tightly clamped by the upper limiting baffle rings 19-3 and the sealing element pressing plate 19-7 via pressing plate bolts 19-5; each lower limiting baffle ring 19-8 is fixed to the outer side wall of each air pipe barrel 19-1, is close to the bottom end of each air pipe barrel 19-1, and is used to be linked and hooked with the adjacent segment of air pipe barrel 19-1 on the lower part; and each air pipe barrel 19-1 is made of stainless steel, nylon or polyurethane material and is smooth in surface, not easy to deform and resistant to corrosion.

The complete set of telescopic air pipe 19 consists of a plurality of segments of sleeves, the upper limiting flange 19-2 of the segment of sleeve with the minimum diameter may be fixedly connected to the telescopic air pipe flange interface 18-4, the segment of sleeve with the maximum diameter is not provided with the lower limiting baffle ring 19-8, but a port of each air pipe barrel 19-1 is provided with the lower interface flange 19-10 used to be fixedly connected to a telescopic air pipe interface 20-4 on the bottom air pipe fixing interface 20.

Figure 4:
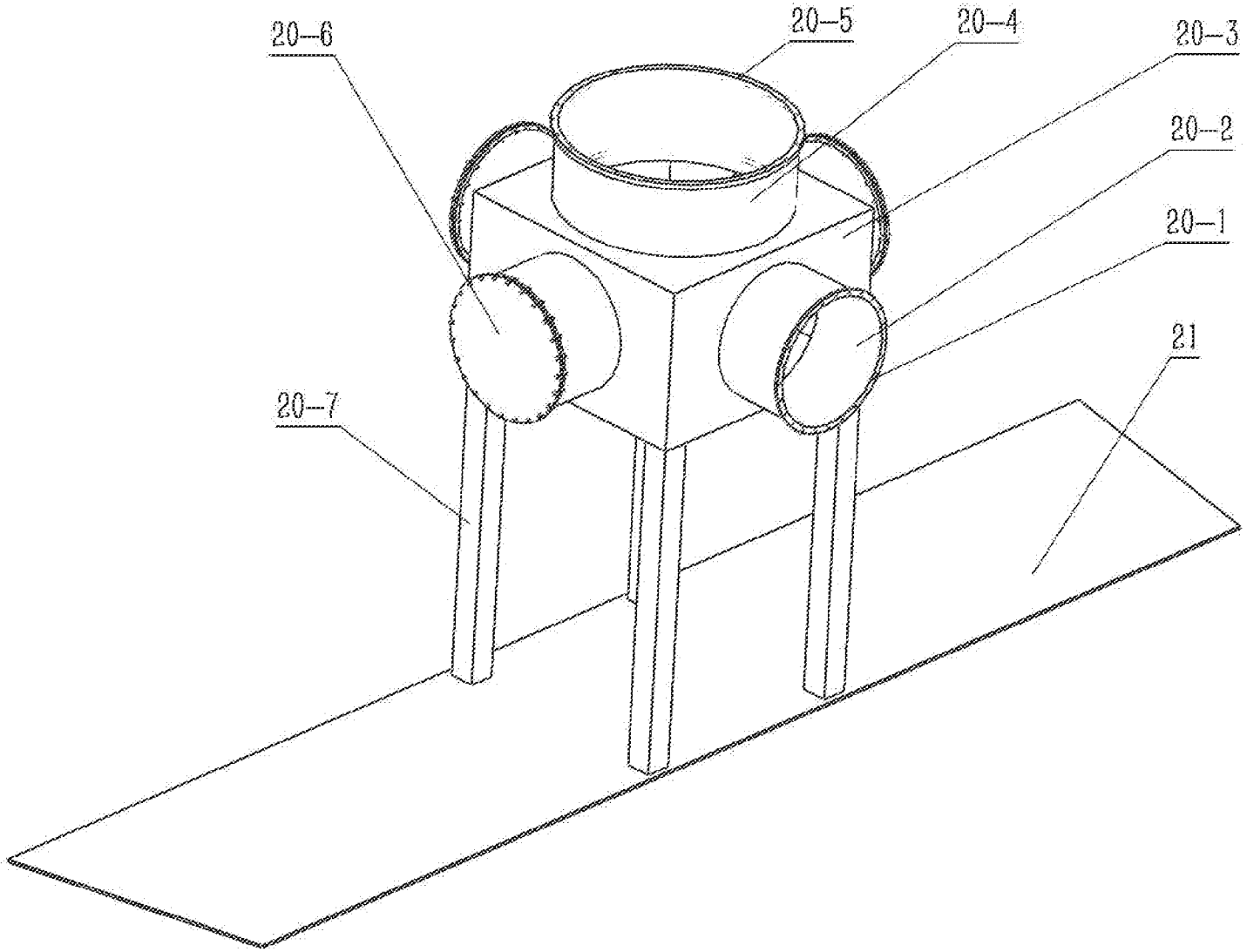
FIG. 4 is a schematic view of a bottom air pipe fixing interface.

As shown in FIG. 4, the bottom air pipe fixing interface 20 is used to be connected to a bottom port of the telescopic air pipe 19, is also connected to a pipeline conveyed to an air supply point, and is used as a fixing seat to be fixed on a spiral framework A-type frame 11 for equipment in the silo; the bottom air pipe fixing interface 20 includes air pipe interface flanges 20-1, interface air pipes 20-2, an air pipe interface cabinet 20-3, a telescopic air pipe interface 20-4, a telescopic air pipe interface flange 20-5, one or more blocking plates 20-6, a support frame 20-7, and the mounting platform 21;

the air pipe interface cabinet 20-3 is of a cabinet structure internally provided with a cavity, enables various pipeline inlets distributed in the cabinet to communicate, and is provided with the telescopic air pipe interface 20-4 on the upper part; an end of the telescopic air pipe interface 20-4 is provided with the telescopic air pipe interface flange 20-5; the telescopic air pipe interface flange 20-5 and the bottom port of the telescopic air pipe 19 are connected by using bolts, so that the bottom port of the telescopic air pipe 19 is fixed; the side walls of the air pipe interface cabinet 20-3 are provided with four interface air pipes 20-2, each interface air pipe 20-2 is provided with the air pipe interface flange 20-1 used for connecting to the ventilation air pipe 22 for delivering gases; and since the four interface air pipes 20-2 and the telescopic air pipe interface 20-4 communicate in the air pipe interface cabinet 20-3, the one or more blocking plates 20-6 are adopted to block the one or more interface air pipes 20-2 not required to be ventilated, and therefore, leakage is avoided. The air pipe interface cabinet 20-3 is fixed to the mounting platform 21 via the support frame 20-7, and the mounting platform 21 is fixed to the spiral framework A-type frame 11.

The fixed ventilation air pipe 22 is disposed on a position, where the walking of personnel is not affected, on a spiral framework 8 and a spiral framework center platform 14 as actually required, an end of the ventilation air pipe 22 communicates with the one or more interface air pipes 20-2, a plurality of air inlets/outlets 23 for ventilation are disposed at intervals in the ventilation air pipe 22, and thus, demands on air supply and air exhaust on these positions are achieved. The position of the second fan 17 may correspond to the positions of first fans 16, that is, the position of the second fan 17 is closest to the positions of the first fans 16, which is beneficial to suction or exhaust of the gases.

Figure 9:
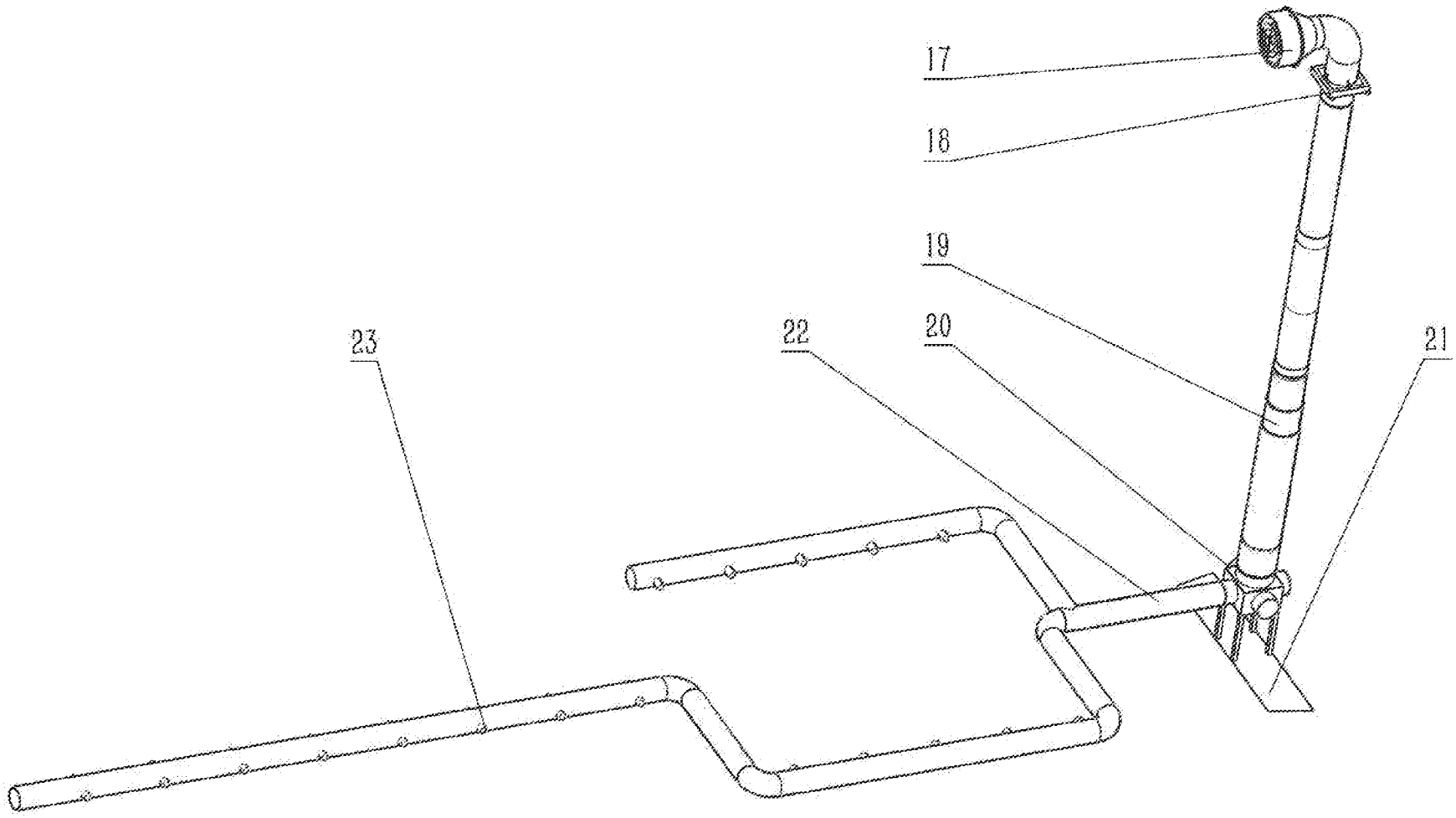
FIG. 9 is a schematic view of an assembly of a telescopic pipeline device.
Figure 10:
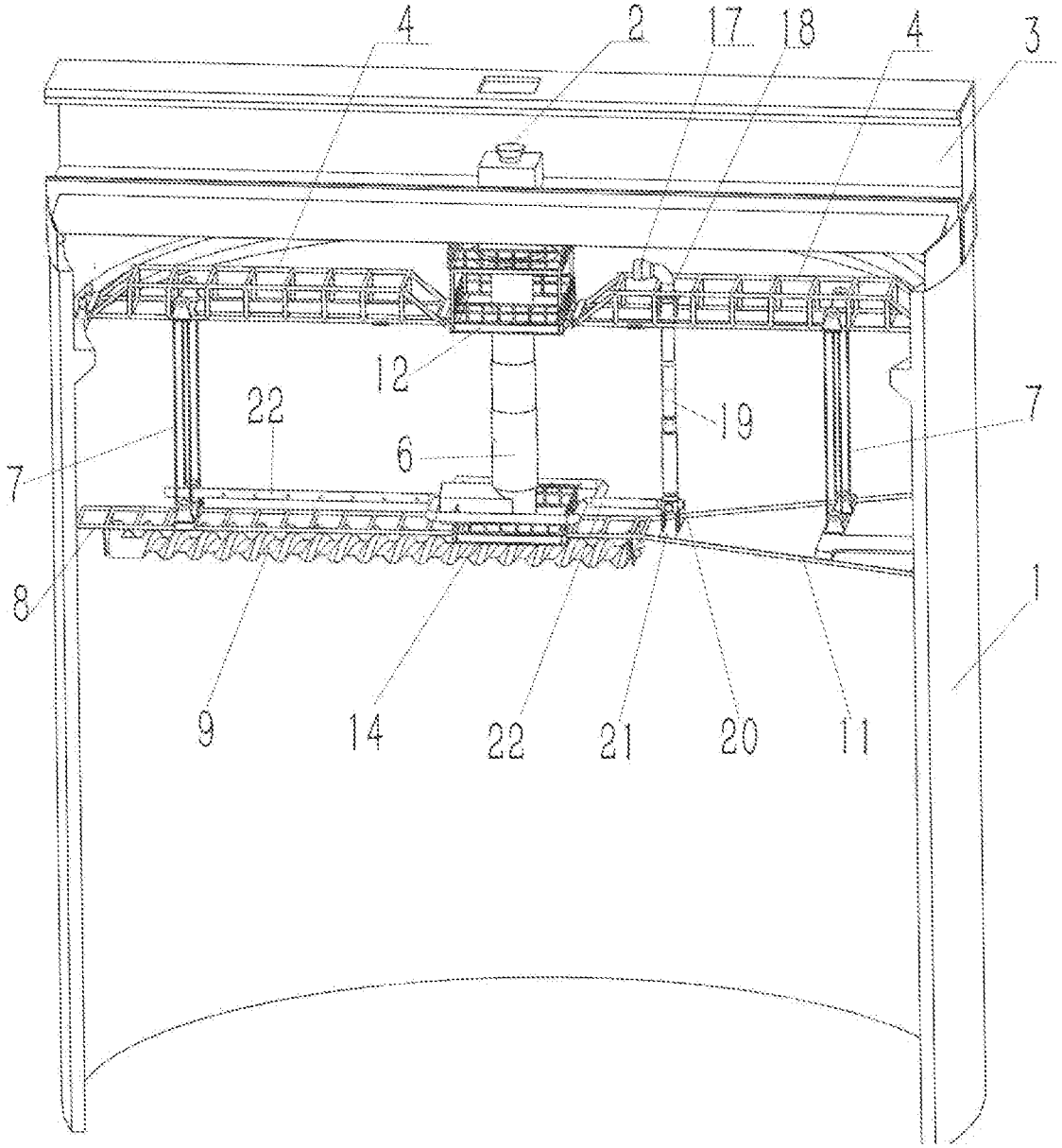
FIG. 10 is a schematic layout view of the telescopic pipeline device.

The schematic view showing the overall structure of the telescopic ventilation pipeline device for a coal storage silo is shown as FIG. 9, a schematic view showing a position where the telescopic ventilation pipeline device for a coal storage silo is mounted on the silo is shown as FIG. 10, and a working principle of the telescopic ventilation pipeline device for a coal storage silo is described:

after the first fans 16 on the silo top cover 15 of the silo are actually used, it is found that gases close to the top inside the silo can be only exhausted, but it is very difficult for silo top fans to exhaust gases on the lower part when the lower part is near a coal heap, particularly, the height of the coal heap is lower, and the distance from the surface of the coal heap to the top of the silo is greater than 15 m. In fact, when the silo top fans operate, no gas flow is felt near the coal heap on the lower part, and therefore, the effect of exchanging the gases in the silo by only utilizing the silo top fans is poorer, the time for exchange is extremely long (longer than 10 h), at the moment, if personnel are required to reach the inside of the silo, i.e. the spiral framework 8, the spiral framework center platform 14 and the spiral framework A-type frame 11 to operate, the harmful gases or nitrogen in inerting coal in the silo is higher in concentration at the moment, it is necessary to wait for an extremely long time during exhaust performed by the first fans 16 on the silo top cover 15, in addition, it is extremely disadvantageous for the physical safety of personnel operating in the silo. Therefore, an air delivery channel may be established in a movement plane space from a position on the top of the silo, i.e. a position near the rotary trestle 4 to the spiral framework 8; this channel can deliver air supplied by the first fans 16 and from the outside of the silo to a position near the upper surface of the coal heap in the silo to ensure that spaces of both of the spiral framework 8 and and the spiral framework A-type frame 11 may receive the air from the outside of the silo, in this way, the gases mainly operated by the personnel can reach the demand, and the operation safety of the personnel can be guaranteed; and original harmful gases on the bottom can also be exhausted to the outside of the silo via various gaps of the silo top cover 15 after being raised.

The rotary trestle 4 and a central winding platform 12 rotate on the top of the silo around an axis of a central telescopic feed pipe 6 and are located on a fixed horizontal plane; the spiral framework 8, the spiral framework A-type frame 11 and the spiral framework center platform 14 are combined together to rotate around the axis of the central telescopic feed pipe 6 and always keep synchronous with the rotation of the rotary trestle 4 under the action of a spiral framework lifting steel wire rope 7; the rotary trestle 4 is always located right above the spiral framework 8 and the spiral framework A-type frame 11; the spiral framework 8, the spiral framework A-type frame 11 and the spiral framework center platform 14 are combined together and may do lifting movement up and down under the traction of the spiral framework lifting steel wire ropes 7 to satisfy the demands on stacking and taking coal, in this way, the distances among combinations of the rotary trestle 4, the spiral framework 8, the spiral framework A-type frame 11 and the spiral framework center platform 14 may change when the silo operates. Each of two sides of the central winding platform is provided with a set of spiral framework lifting steel wire rope, and the spiral framework lifting steel wire ropes are symmetrically disposed with respect to a mounting central axis; one side of the spiral framework center platform 14 is provided with the spiral framework 8 and is equipped with a screw conveyor 9, and the other side thereof is only equipped with the spiral framework A-type frame 11 of which the weight is apparently smaller than that of the spiral framework on the other side, the spiral framework A-type frame is not equipped with other equipment, and therefore, it is completely reasonable to dispose ventilation equipment in this region.

The two first fans 16 are set to have functions of forward and reverse rotation, also operate separately or simultaneously and are used to exhaust gases in the silo and supply air to the inside of the silo. The spiral framework A-type frame 11 is provided with the bottom air pipe fixing interface 20 used to be connected and fixed to a lower interface of the telescopic air pipe 19. When the telescopic air pipe 19 normally extends out, relative slip is generated between two adjacent segments on the telescopic air pipe 19, so that the mutual linking distance becomes long; when the telescopic air pipe 19 extends out, the segment large in diameter moves downwards, the upper limiting baffle ring 19-3 of this segment is in contact and hooked together with the lower limiting baffle ring 19-8 of the segment on the upper part, at the moment, the sealing element 19-6 extending out may be in direct contact with the upper surface of the lower limiting baffle ring 19-8 to generate a sealing effect, thereby preventing gases delivered in a pipeline from being leaked; when the lower limiting baffle ring 19-8 of the previous segment is in contact with the upper limiting baffle ring 19-3 of the adjacent next segment of air pipe barrel larger in diameter, the relative movement between the two segments stops, and extension does not occur again; a combination composed of the spiral framework 8, the spiral framework A-type frame 11 and the spiral framework center platform 14 moves downwards under the traction of the spiral framework lifting steel wire rope 7, the telescopic air pipe 19 completely extends, the upper limiting baffle ring 19-3 and the lower limiting baffle ring 19-8 on each of all the air pipe barrels 19-1 are hooked together with the lower limiting baffle ring 19-8 and the upper limiting baffle ring 19-3 of the adjacent segment of air pipe barrel 19-1; conversely, when the telescopic air pipe 19 shrinks, that is, the combination composed of the spiral framework 8, the spiral framework A-type frame 11 and the spiral framework center platform 14 moves upwards under the traction of the spiral framework lifting steel wire rope 7, two segments of air pipe barrels 19-1 on the downmost on the lower end of the telescopic air pipe 19 start to shrink, i.e. relatively move to be nested together, the segment smaller in diameter is inserted into the segment larger in diameter, after complete shrinkage, and the segment of air pipe barrel smaller in diameter and adjacent to the segment smaller in diameter further starts to shrink and move, in this way, a shrinkage action of the telescopic air pipe 19 is formed, the relative movement between the two adjacent segments of air pipe barrels 19-1 plays a role in telescoping, and the demand on change of the distance between the combination composed of the spiral framework 8, the spiral framework A-type frame 11 and the spiral framework center platform 14 and the rotary trestle 4 is satisfied.

The ventilation pipeline 18-3 is connected and fixed to an upper port of the telescopic air pipe 19, and the other end thereof is connected to the second fan 17; the ventilation pipeline 18-3 is provided with a bent segment which may be adjusted as actually required; and the position of the second fan 17 is matched with the silo top fans 16 of the silo, in this way, it is ensured that the air inlets/outlets of the first fans 16 correspond to an air inlet/outlet of the second fan 17, and the maximization of the ventilation efficiency is achieved.

The spiral framework 8 and the spiral framework center platform 14 are used as a region for personnel entering the silo to move, and the ventilation air pipe 22 is disposed in this region; when air is supplied to the inside of the silo, one of the first fans 16 supplies air to the silo, at the moment, the rotary trestle 4 may stop below the first fan 16 supplying air to ensure that the first fan 16 corresponds thereto, and meanwhile, the second fan 17 supplies air to the downside, in this way, fresh air outside the silo can be delivered to the ventilation air pipe 22 at the downside in the silo via the telescopic air pipe 19 and is finally exhausted via the air inlets/outlets 23, so that it can be ensured that the air in these regions satisfies demands, and the working safety of equipment maintenance, routing inspection and operation is guaranteed. Finally, a great deal of air outside the silo is delivered to the inside of the silo to raise or dilute various original gases, these gases can rise to gaps on junctions with the silo top cover 15 along the wall of the silo and are exhausted to the outside of the silo, and by such a ventilation process, rapid exchange between the gases outside the silo and the gases inside the silo is achieved. The volume of an empty silo is 100000 cubic meters, and there are only gases in a space which is tens of thousands of cubic meters after coal stacking; if the ventilation rate of the fan 17 is 30000 cubic meters per hour, the air in the silo can be exchanged to be clean within a few hours; in addition, a ventilation position is set in a region for the personnel to work, and therefore, the safety of working personnel is greatly guaranteed.

During exhaust, the first fans 16 exhausts air to the outside of the silo, and meanwhile, the second fan 17 may be matched with the first fans 16 in an air exhaust manner to exhaust the air on the bottom to a position near the top of the silo, which is beneficial for the first fans 16 to exhaust these gases. By using such a method, various gases on the bottom of the silo can be exhausted to the outside of the silo, and meanwhile, external air can also flow via a gap between the wall of the silo and the silo top cover 15, which is, in fact, also a method for exchanging gases in the silo.

The present embodiment provides a telescopic ventilation pipeline device for a coal storage silo, which is reasonably disposed and mounted by means of characteristics of the structure and working operation of the silo, so that the demand for delivering air from the rotary trestle 4 on the upper part of the silo to the spiral framework on the lower part of the silo is satisfied. There is no mutual interference between the normal operation of the device and the operation of mechanisms of the silo, and therefore, the demand on air delivery during operation of the silo can be satisfied. During actual ventilation, there may be various combined working methods for the first fans 16, however, the gases inside the silo can be directly exhausted to the outside of the silo, so that the ventilation efficiency is increased, and the operation of the silo and the safety of working personnel are greatly guaranteed.

As above, preferred specific embodiments of the present disclosure have been described in detail. It should be understood that various modifications and variations can be made by the ordinary skill in the art without creative work according to the conception of the present disclosure. Therefore, technical solutions which can be obtained by the skilled in the art by logical analysis, reasoning or finite experience on the basis of the prior art according to the conception of the present disclosure shall fall within the protective scope determined by the claims.

What is claimed is:

1. A telescopic ventilation pipeline device for a coal storage silo, wherein the silo is internally equipped with a first fan and a set of coal stacking/taking equipment that comprises a rotary trestle, a trestle traveling mechanism, a central rotating platform, a central telescopic feed pipe, a spiral framework, a screw conveyor, a spiral framework A-type frame; wherein the telescopic ventilation pipeline device comprises:

a second fan, an upper air pipe fixing interface, a telescopic air pipe, a bottom air pipe fixing interface, a mounting platform, and a ventilation air pipe, the telescopic air pipe being parallel to the central telescopic feed pipe of the silo, one end of the upper air pipe fixing interface being connected to the second fan, the other end thereof communicating with the top end of the telescopic air pipe, the bottom end of the telescopic air pipe, the bottom air pipe fixing interface and the ventilation air pipe communicating in sequence, and the bottom air pipe fixing interface being fixed to the spiral framework A-type frame of the silo.

2. The telescopic ventilation pipeline device for a coal storage silo of claim 1, wherein:

the telescopic air pipe comprises a plurality of segments of air pipe barrels coaxially nested in sequence;

the upper end of each air pipe barrel located in the middle is provided with an upper limiting baffle ring, and the lower end thereof is provided with a lower limiting baffle ring;

the lower end of the air pipe barrel located on the top end is provided with a lower limiting baffle ring;

the upper end of the air pipe barrel located on the bottom end is provided with an upper limiting baffle ring, and the lower end thereof is provided with a lower interface flange;

the lower interface flange is fixedly connected to the bottom air pipe fixing interface; and the air pipe barrel located above is hooked, via a lower limiting baffle ring thereof, with an upper limiting baffle ring of the adjacent air pipe barrel located below.

3. The telescopic ventilation pipeline device for a coal storage silo of claim 2, wherein the upper end of each air pipe barrel is provided with an upper limiting flange, and the upper limiting baffle ring is fixed to the upper limiting flange via fixing bolts.

4. The telescopic ventilation pipeline device for a coal storage silo of claim 3, wherein:

the telescopic air pipe further comprises a sealing element and a sealing element pressing plate; the inner side wall of each air pipe barrel is provided with a step;

the sealing element pressing plate is located on the step; an annular groove for placing the sealing element is formed in the bottom of each upper limiting baffle ring;

the sealing element is located in the annular groove; and the sealing element is tightly clamped by the upper limiting baffle ring and the sealing element pressing plate via pressing plate bolts.

5. The telescopic ventilation pipeline device for a coal storage silo of claim 2, wherein each air pipe barrel is made of stainless steel, nylon or polyurethane material.

6. The telescopic ventilation pipeline device for a coal storage silo of claim 1, wherein the upper air pipe fixing interface comprises a fixing seat and a ventilation pipeline;

one end of the ventilation pipeline is provided with a fan flange interface for connecting to the second fan, and the other end thereof is provided with a telescopic air pipe flange interface for connecting to an upper port of the telescopic air pipe;

the fixing seat is sleeved on the ventilation pipeline; the fixing seat is provided with fixing feet; and the fixing seat is fixed to the rotary trestle of the silo via the fixing feet.

7. The telescopic ventilation pipeline device for a coal storage silo of claim 1, wherein:

the bottom air pipe fixing interface comprises one or more interface air pipes, an air pipe interface cabinet, a telescopic air pipe interface, one or more blocking plates, a support frame, and the mounting platform;

the air pipe interface cabinet respectively communicates with the telescopic air pipe interface and the one or more interface air pipes; an end of the telescopic air pipe interface is provided with a telescopic air pipe interface flange; the telescopic air pipe communicates with the telescopic air pipe interface via the telescopic air pipe interface flange;

ends of the one or more interface air pipes are provided with air pipe interface flanges; the ventilation air pipe communicates with the one or more interface air pipes via the air pipe interface flanges;

the air pipe interface cabinet is fixed to the mounting platform via the support frame; and the mounting platform is fixed to the spiral framework A-type frame of the Eurosilo.

8. The telescopic ventilation pipeline device for a coal storage silo of claim 7, wherein a plurality of interface air pipes are provided, and the plurality of interface air pipes are uniformly disposed on side walls of the air pipe interface cabinet.

9. The telescopic ventilation pipeline device for a coal storage silo of claim 8, wherein the bottom air pipe fixing interface further comprises the one or more blocking plates for blocking the one or more interface air pipes, and the one or more blocking plates are matched with the air pipe interface flanges.

10. The telescopic ventilation pipeline device for a coal storage silo of claim 1, wherein a plurality of air inlets/outlets for ventilation are disposed at intervals in the ventilation air pipe.

* * * * *